United States Patent [19]

Serracant-Clermont et al.

[11] Patent Number: 5,012,657

[45] Date of Patent: May 7, 1991

[54] MACHINE FOR THE CONTINUOUS DYNAMIC-FLUID TREATMENT OF AGGREGATED FILIFORM MATERIALS

[76] Inventors: Jose M. Serracant-Clermont, V. Gracia, 52; Juan Serracant-Clermont, A. Concordia, 25, both of Sabadell, Spain

[21] Appl. No.: 421,595

[22] Filed: Oct. 16, 1989

[30] Foreign Application Priority Data

Oct. 14, 1988 [ES] Spain ..... 8803121

[51] Int. Cl.[5] ..... D06B 5/08

[52] U.S. Cl. ..... 68/5 E; 68/158; 68/177; 226/118

[58] Field of Search ..... 68/5 D, 5 E, 158, 177; 226/118; 26/20, 21

[56] References Cited

U.S. PATENT DOCUMENTS

| | | | |
|---|---|---|---|
| 2,403,311 | 7/1946 | Steele | 226/118 X |
| 2,764,009 | 9/1956 | Sarti | 68/158 X |
| 3,019,631 | 2/1962 | Freyberg | 226/118 X |
| 3,374,646 | 3/1968 | Fleissner | 68/158 X |
| 3,805,407 | 4/1974 | Fleissner | 226/118 X |
| 4,050,270 | 9/1977 | Vecchia | 68/158 |

FOREIGN PATENT DOCUMENTS

| | | | |
|---|---|---|---|
| 1460210 | 11/1968 | Fed. Rep. of Germany | 68/177 |
| 23720 | 7/1972 | Japan | 68/158 |
| 338270 | 6/1972 | U.S.S.R. | 68/158 |
| 1008331 | 10/1965 | United Kingdom | 226/118 |

*Primary Examiner*—Philip R. Coe

*Attorney, Agent, or Firm*—Fleit, Jacobson, Cohn, Price, Holman & Stern

[57] ABSTRACT

Machine for the continuous dynamic-fluid treatment of grouped filiform materials, which includes in combination a device (9) to feed previously treated grouped filiform materials (T), a device (1) for producing separation or change of density, or separation and change of density of the materials, and a treatment section (2) to which the materials are fed which includes a tubular chamber for pressure treatment of the materials having at least one perforated area (15) through which treating fluid circulates, the chamber being formed by a fixed part (12) shaped like a channel (17) and a moving part (13) which closes one side of the channel and has carrying elements (21) thereon for the materials comprised of transverse radial shoulders, the channel having entry (19) and exit (20) openings for the materials to be treated.

12 Claims, 6 Drawing Sheets

MACHINE FOR THE CONTINUOUS DYNAMIC-FLUID TREATMENT OF AGGREGATED FILIFORM MATERIALS

BACKGROUND OF THE INVENTION

This invention relates to a machine for the continuous fluid-dynamic treatment of group filiform materials, which permits steaming, washing, dyeing, etc., of cords, wicks, belts, threads and the like.

Machines for the treatment of textile materials with fluids under pressure already exist, consisting of a long tubular enclosure having perforated areas covered by a jacket which forms a chamber through which the fluid circulates under pressure in the form of water vapor or some other form, which comes in contact with the textile material to be treated inside the chamber; such machines include means for conveying the textiles. There is another type of machine that requires the simultaneous treatment of two cords, each of them located at one side of the conveyor.

Such machines have the drawback of having to operate with two wicks at the same time and they are very long. Therefore, they require a lot of space for installation, for which reason their penetration of the marketplace is limited.

On the other hand, there are machines for steam treatment of textile materials with only one wick, cord, etc. which have a pressure limitation, because said machines are capable of producing only minimal pressure, due to the fact that the textile material cannot be made sufficiently watertight. For example, there are machines for steam treatment which, when the textile material leaves a crimper, apply the steam treatment with a pressure on the order of 0.2 kg/cm$^2$, the textile being retained when exiting by a retaining plate. There are also other machines which, when the textile material is exiting the crimper, apply a pressure treatment between two pairs of feed rollers located at both ends of the treatment area, permitting the application of steam pressure on the order of 0.5 kg/cm$^2$.

As a result of their pressure limitation, the usefulness of these machines is limited because they cannot be used to carry out certain processes, or obtain the necessary results with said processes.

In many cases, in order to subject the textile materials to treatment with fluid under pressure it is not possible to do so directly by simply connecting two machines through a conduit, as in the case of textile materials exiting a crimper, because the textile material to be treated with fluids has a different linear mass in each machine, the crimper preceding machine and the fluid process following.

BRIEF SUMMARY OF THE INVENTION

The machine for the continuous dynamic-fluid treatment of grouped filiform materials of the present invention, eliminates the failings previously mentioned, since, on one hand, it allows the treatment of one or more cords, wicks, etc., minimizes to the maximum extent the space necessary for the fluid treatment machine, and has no pressure limitations for treatment required by the majority of the known or commonly used processes; similarly it allows the direct or indirect feeding of the textile material when passing from a machine, such as a crimper, to the following fluid pressure treatment machine.

The machine for the continuous dynamic-fluid treatment of grouped filiform materials of this invention corresponds to the type which has a tubular enclosure with at least one perforated area covered with a jacket which forms a chamber through which circulates the fluid for pressure treatment, and has an entry to feed the material to the enclosure in watertight condition, and an exit, and carrying means which carry the material through the enclosure, and it is characterized principally by having, in combination, a feeder device for the grouped filiform materials pleated or unpleated, previously processed which carries out the separation or the change of density, or the separation and change of density of the materials, and a dynamic-fluid treatment device to which the materials are fed, that includes an enclosure for pressure treatment formed by a stationary part shaped essentially as a rectangular channel, and a moving part related to the fixed part, which moving part encloses the channel and makes it watertight by a sealing means, allowing the circulation and action of the fluid on the material to be treated, the moving part having carrying devices for the material consisting of transversal shoulders pointed toward the inside of the channel, which has an open area for entry and exit of the material to be treated.

The feeder is a device for separation, advancing and grouping of filiform materials which is composed of two moving elements facing each other which are alternating and adjustable in synchronization or out of phase, mutual separation and frequency of movement, and includes entry and exit channels respectively for the textile materials to be treated in order to receive them from the preceding treatment and deliver them to the dynamic-fluid treatment device, and the tubular enclosure for fluid-dynamic treatment is ring-shaped with an opening part for entry and exit of the material to be treated.

The moving and facing parts of the feeder are each composed of alternating motor-powered rotors. Such rotors may be lobed with the respective lobes out of phase but turning together or may have serrated surfaces.

In turn, the sizes of the entry and exit channels to the feeder device are related to the changes in the linear mass of the materials to be treated which are produced by the feeder.

Similarly the dynamic-fluid treatment device has a fixed part or stator, constituted by a circular torus in the shape of a rectangular channel in cross-section open in the direction of its axis, and a moving part or rotor constituted by a metallic tire which turns, and which has on its exterior surface a series of radially protruding transverse shoulders for carrying the material which extend through part of the cross-section of the channel for processing of the material, and includes a watertight sealing means between both the fixed and moving parts. This stator includes at least one processing area in which its channel is perforated leading to chambers built in the outer surfaces and at the end of the channel and are provided with openings for the entry and exit for the pressure treatment fluids.

BRIEF DESCRIPTION OF THE DRAWINGS

A more comprehensible and detailed description follows with reference to the accompanying drawings which show a practical embodiment of the machine for continuous fluid-dynamic treatment of grouped filiform materials with the above described characteristics, shown for illustrative purposes only and which are not intended to suggest any limits to the scope of this invention, and wherein.

DETAILED DESCRIPTION

Figure 1:
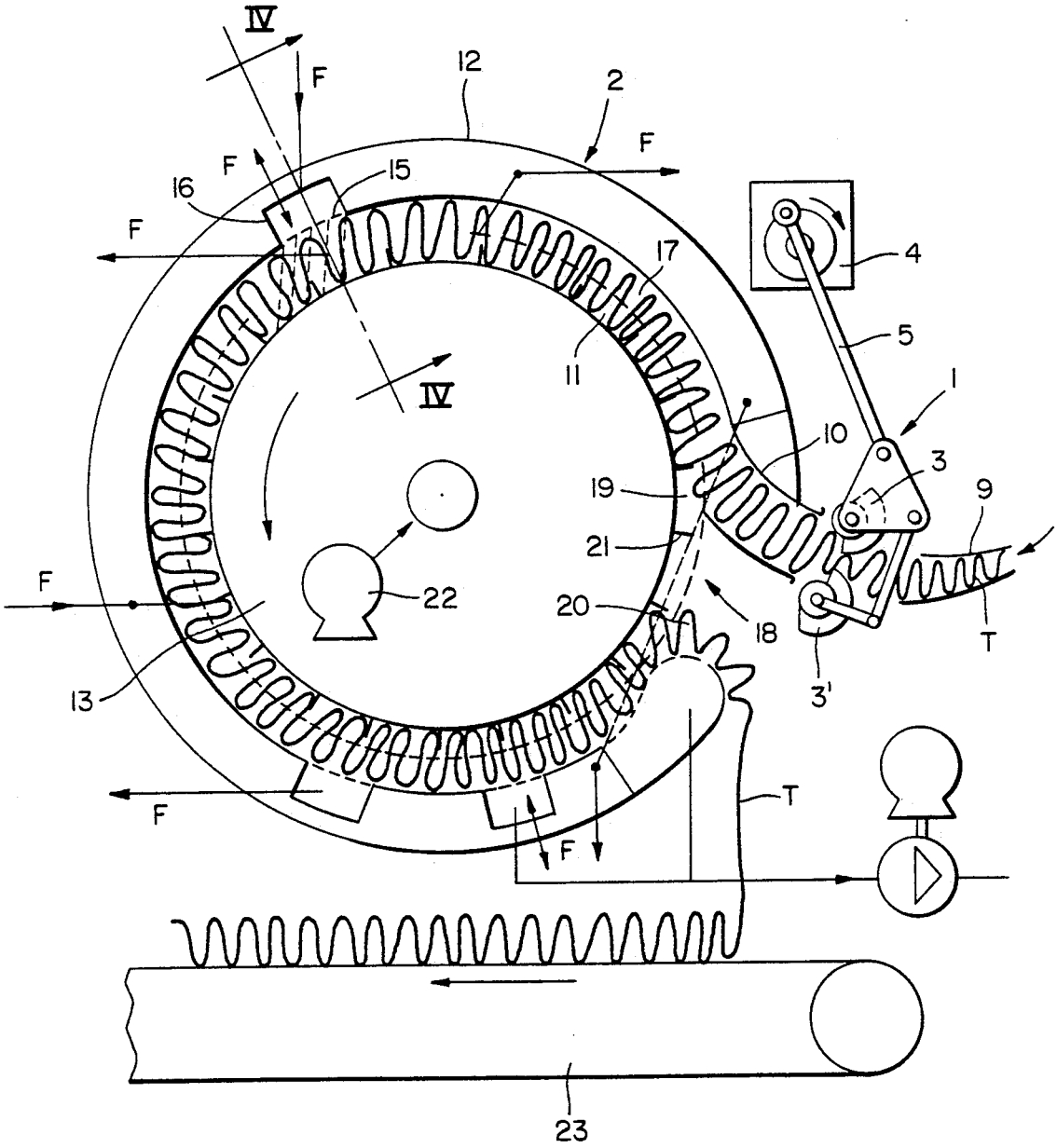
FIG. 1 is a schematic cross-sectional view of the machine of this invention.

As shown in the drawings, the machine for continuous dynamic-fluid treatment of grouped filiform materials of this invention, includes a feeder device for the grouped filiform textile materials T and a device for fluid-dynamic treatment 2. Feeder 1 includes two rotors 3, 3' facing each other and alternatingly activated by a motor 4 through a connecting rod 5, a connection member 6, a counter connecting rod 7, an arm 8, an entry channel 9 for the textile materials T and an exit channel 10 to feed the textile materials to the dynamic-fluid treatment device 2. The device 2 is composed of a ring shaped tubular chamber 11 which is formed by a fixed part or exterior stator 12 in the shape of an essentially rectangular channel in cross-section and a moving part or interior rotor 13 rotatable relative to the fixed part which closes the channel by means of a sealing arrangement 14, 14' (see FIG. 4) which allows the circulation and action of the treatment fluid on the textile material T to be treated, which fluid enters the channel through the perforated areas 15 covered by jackets 16 which create the chambers through which the fluid F for pressure treatment circulates.

The fixed and moving parts 12 and 13 which define the 14 processing channel 17 have an opening area 18 which contains the entry point 19 for the textile material T to be processed into the fluid treatment device 2, and an exit point 20 after the treatment.

The moving part has a carrying means for the material T being treated which is comprised of a number of transversal, or radial, shoulders 21 (see FIG. 2) extending toward the inside of the channel 17 for fluid pressure treatment for at least a part of the cross-section of the channel.

The dynamic-fluid treatment device 2 introduces the treating fluid F in the chambers 16 over the perforated areas so that it penetrates the textile material T being treated.

Figure 2:
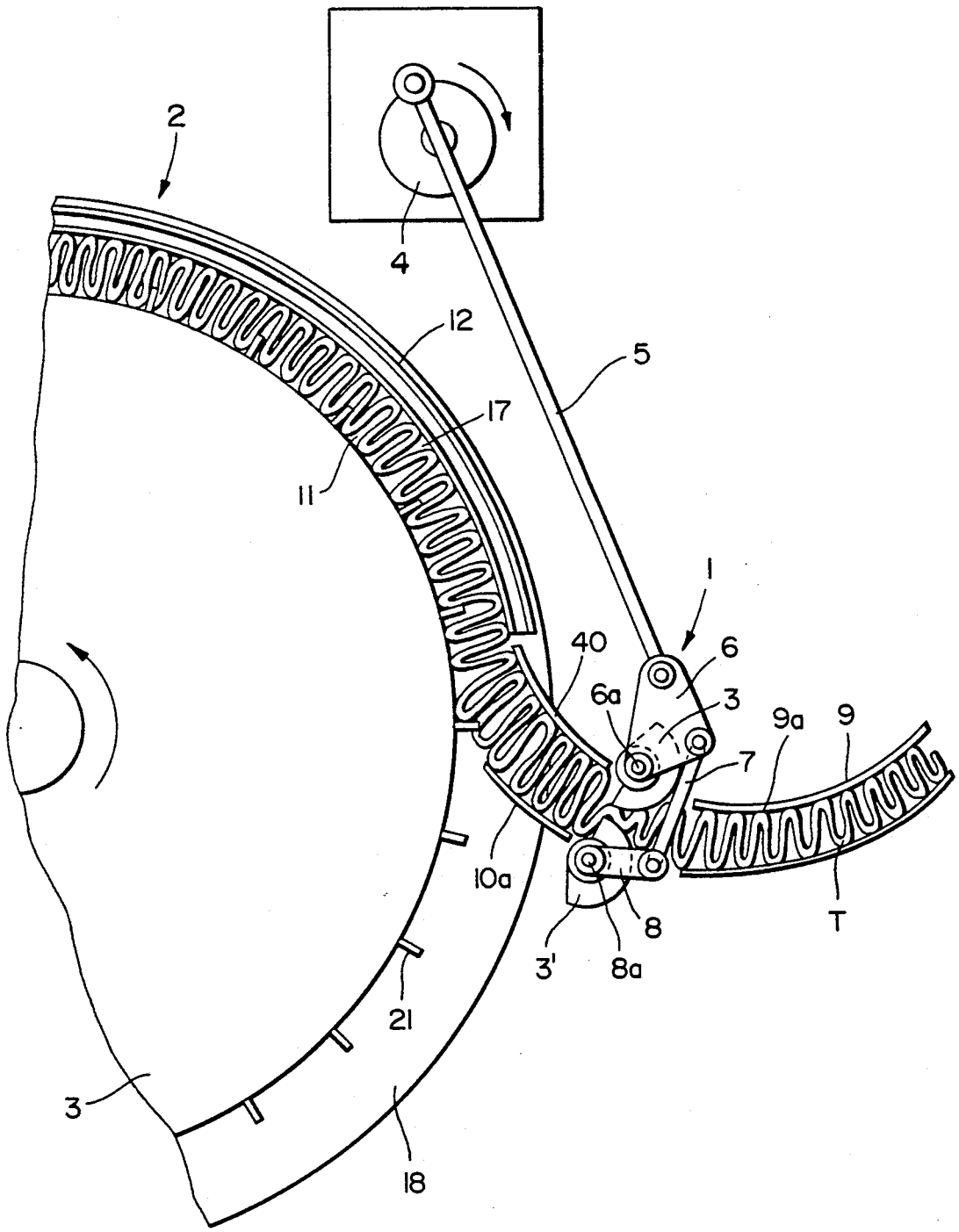
FIG. 2 is an enlarged view of a part of FIG. 1 showing in greater detail the feeder and part of the dynamic-fluid treatment device.

In the operation of the machine of the invention, the previously processed grouped filiform textile materials T enter through the entry channel 9, as illustrated in FIGS. 1 and 2, into the feeder 1 in which the two rotors 3, 3' which are lobed and face each other, act on textile material T carrying out any one of the following functions: separation or change of density, or separation and change of density, passing the materials T to exit channel 10 of the device, entering through entry point 19 into channel 17 of the tubular ring-shaped chamber, the material T being moved forward in the pleated fashion by shoulders 21 of the moving part or rotor 13 powered by a motor 22. Material T is subject to the corresponding treatment with steam F under pressure passing through perforated areas 15 of the fixed part or stator 12. After treatment, the material T leaves the dynamic-fluid treatment device 2 through exit point 20 and is picked up below by a conveyor belt.

Figure 3:
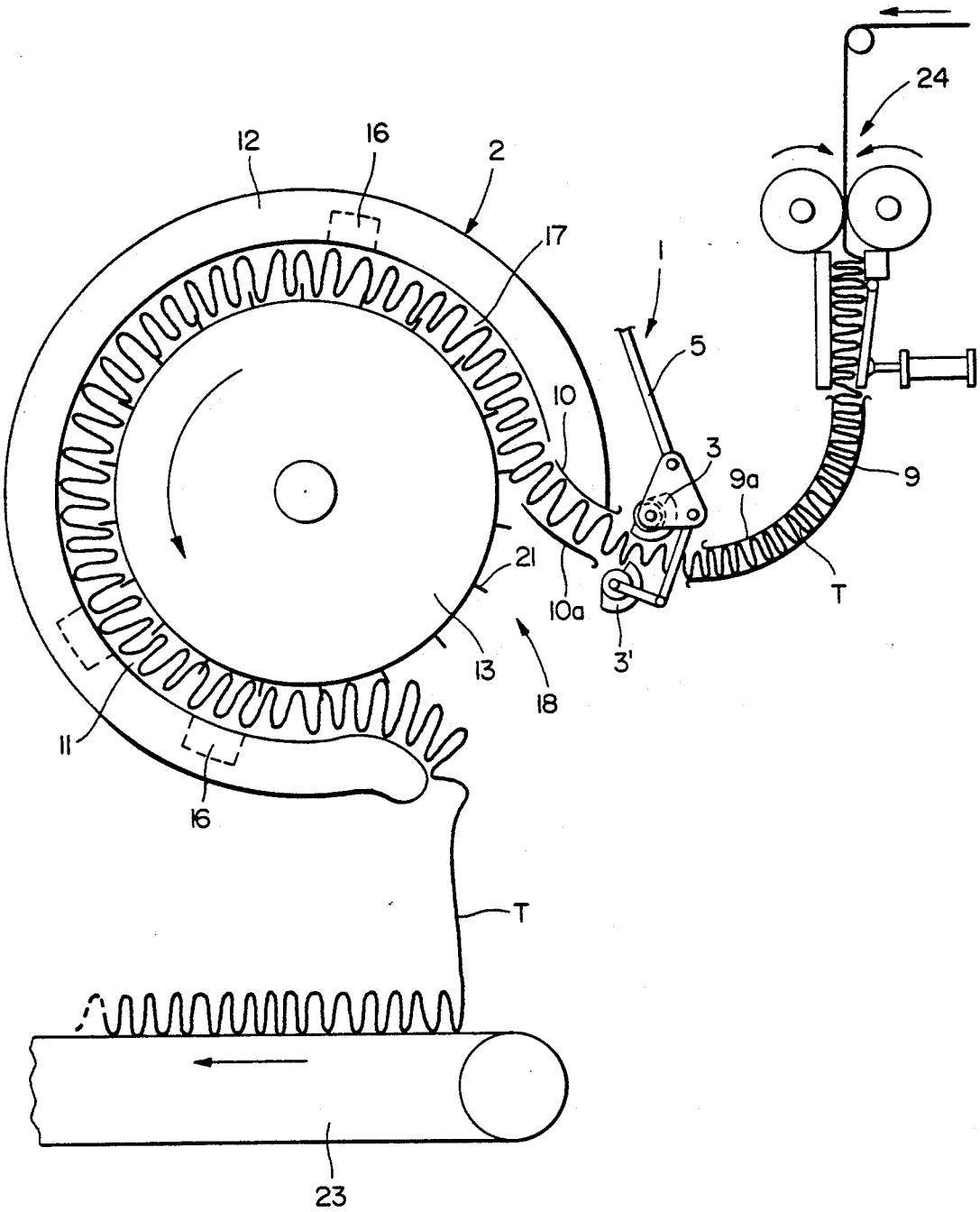
FIG. 3 is a view similar to FIG. 1 showing the machine of the invention associated with the exit of a crimper.

FIG. 3 illustrates a practical embodiment of the invention applied to the exit point of a crimping machine 24, which delivers the crimped material T to the entry channel 9 which after going through feeder 1 is delivered through exit channel 10 to the dynamic-fluid treatment device 2 and deposited on exiting on conveyor 23.

Figure 4:
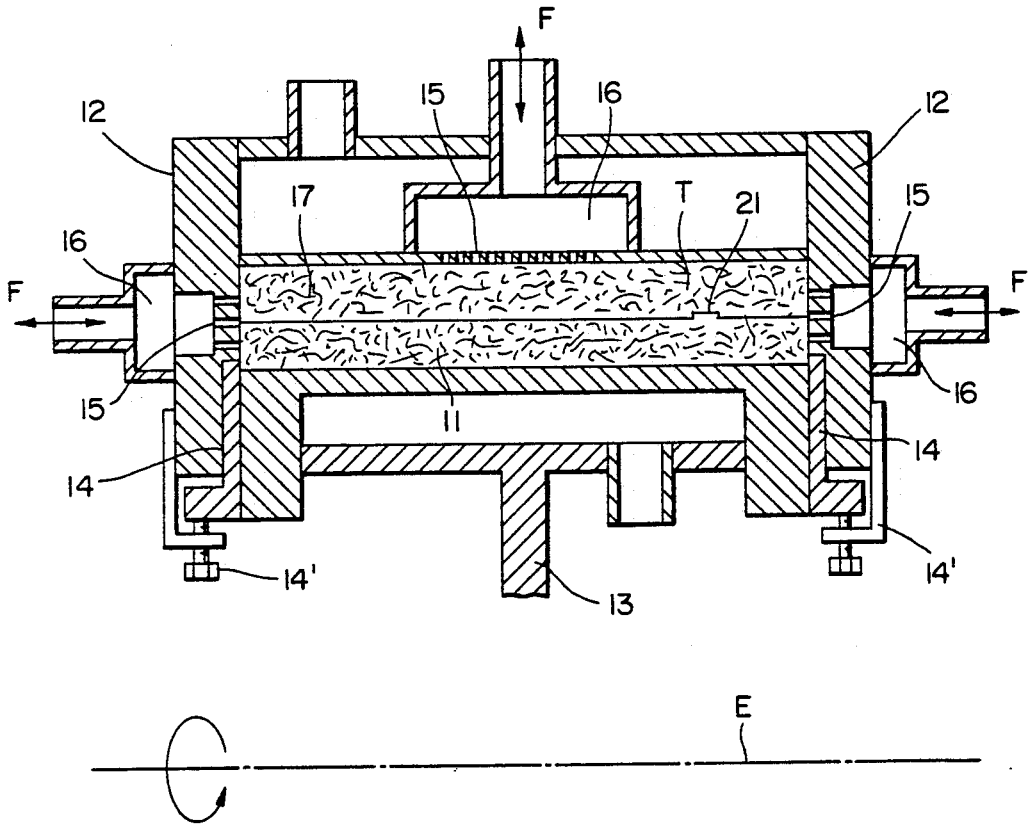
FIG. 4 is a cross-sectional view which shows a section of the device for dynamic-fluid treatment taken along line IV—IV in FIG. 1.

FIG. 4 illustrates the fluid-dynamic treatment device shown in FIGS. 1 and 3 in which the fixed part of stator 12 consists of a circular torus which forms the previously mentioned rectangular channel 17 while the moving part or rotor 13 is constituted by a metallic tire turned by motor 22 and having radial shoulders 21 which carry the textile material T.

The stator or fixed part 12 has perforations 15 which open into chambers 16 built in the lateral wall and, between the ends of channel 17 and has entry and exit points for the pressure treatment fluid F. The stator is outside the moving part or rotor 13 as illustrated in FIG. 4 and the moving part or rotor 13 rotates around a geometric axis E.

Figure 6:
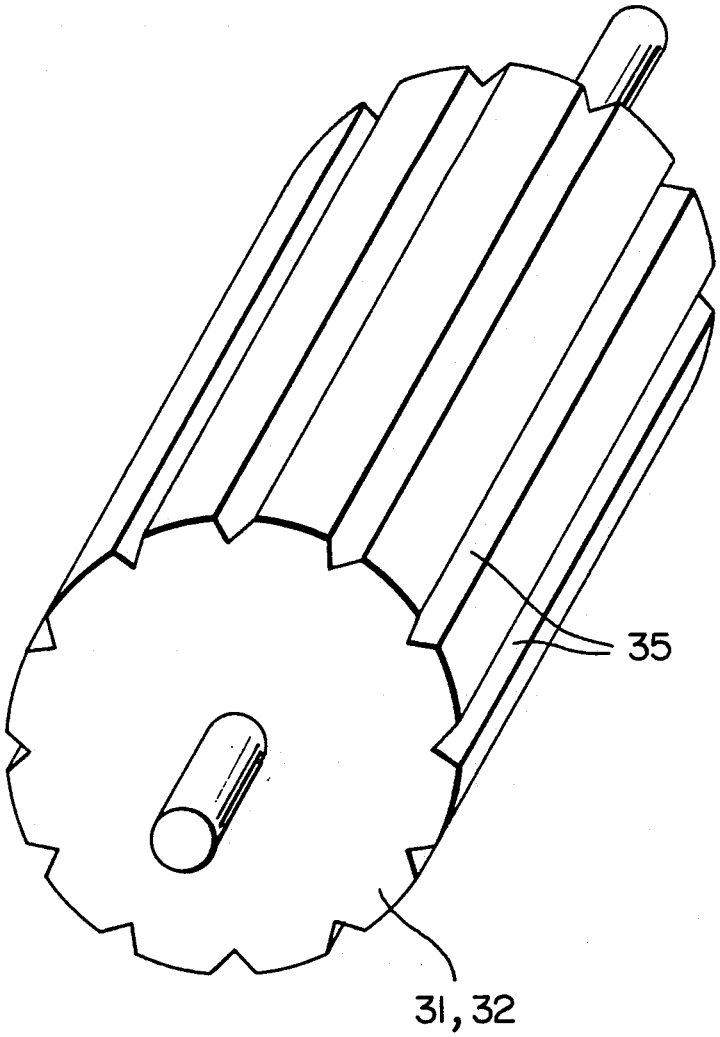
FIG. 6 is an enlarged perspective view showing the embodiment of rotors having a serrated surface as in FIG. 5.

The rotors 3, 3' of the feeder device 1 are faced alternatingly and are adjustable in synchronization or out of phase for mutual separation and frequency of movement. Rotors 13, 13' may be lobed out of phase when turning together or may have their surfaces serrated longitudinally as shown in FIG. 6.

The dimensions of the entry and exit channels 9 and 10 of feeder 1 are related to the variation of the linear mass of the textile material T provided by the feeder 1, entry channel 9 being smaller in cross-section so that the material therein is more dense than in channel 10 per unit length.

FIG. 2 shows the manner in which rotors 3 and 3' carry out the functions of separation or change of density, or separation and change of density, as previously described. As motor 4 rotates, since the end of connecting rod 5 is pivotally connected eccentric to the axis of rotation of motor 4, connecting rod 5 is reciprocated and due to the pivotal connection of the other or lower end of connecting rod 5 to connecting arm 6, the latter is rotated about its axis 6*a*. Rotor 3 is connected for rotation to axis 6*a* and is thereby rotated with connecting arm 6. Connecting rod 7 is pivotally connected at one end to connecting arm 6 and is therefore reciprocated by rotation of connecting arm 6. The other end of connecting rod 7 is pivotally connected to arm 8 which is thereby rotated about its axis 8*a* to which rotor 3' is connected to be rotated thereby. Rotors 3 and 3' extend into the gap between the ends of the entry and exit channels 9 and 10, respectively, adjacent feeder device 1 so that they engage the filiform material T fed through entry channel 9, which is in a compact folded form as shown more clearly in FIGS. 1 and 3, i.e. material T being fed through entry channel 9 is denser being more compact than the same material leaving feeder device 1 and passing through the processing channel 17. This is due to the fact that the cross-sectional area of the entry channel 9 is smaller than the cross-sectional area of exit channel 10 and the alternating rotation of the rotors 3 and 3' due to their operation by the eccentric connection of connecting rod 5 to motor 4 causes the lobed parts of the rotors within the path of flow of the material T to engage in the spaces between the folds of the material to thereby open the folds to reduce the density thereof as the material T moves from the smaller cross-sectional area of entry channel 9 into the larger cross-sectional area of channel 10.

Thus, rotors 3, 3' produce an impulsive advance of the grouped filiform material T and separate a part of them by engagement between the folds. This separation is in the nature of a disaggregation of the folded and packed material which reduces the density of the material and thus the mass per unit of length, i.e. linear mass.

Figure 5:
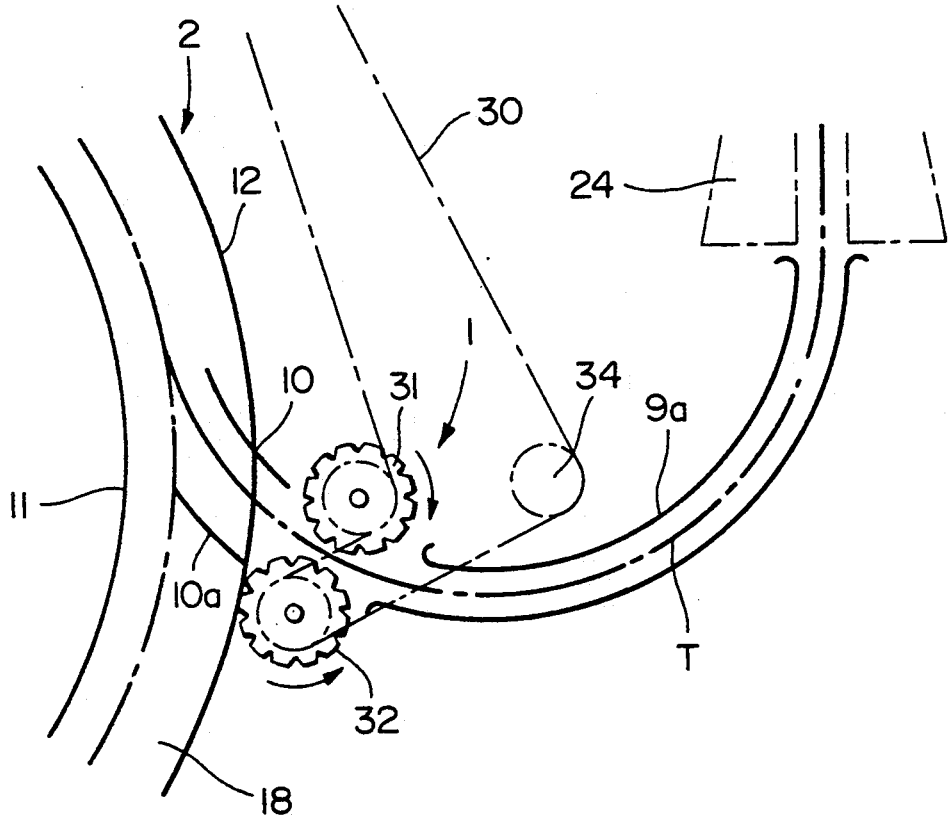
FIG. 5 is a schematic view showing the embodiment using serrated rotors in the feeder-device.

FIG. 5 shows schematically the embodiment of the invention wherein the rotors of feeding device 1 are serrated on their outer surfaces as shown in FIG. 6. In this embodiment the rotors 31 and 32 are driven by a belt 30 which is in turn driven by motor 4 and passes around idler pulley 34. Idler pulley 34 is a conventional unit in a belt drive system and the manner in which the belt is driven by motor 4 is not shown, since this would be readily apparent to anyone familiar with the art. In operation of this embodiment, rotors 31 and 32 are driven in the direction of the arrows as shown in FIG. 5 by belt 30 and are spaced so that the material T is fed between them and the serrated surfaces 35 which engage with the material and change the configuration thereof from the more compact or dense configuration in inlet or entry channel 9 to the less dense configuration in the larger cross-sectional area of exit channel 10.

It is worth pointing out that the feeder device can feed textile material either in the form of one or several cords, belts or threads and the like, pleated or unpleated. Thus, this invention may be coupled directly or indirectly to a crimper from which the textile material exits with or without pleats in the cases of aggregated filiform materials.

It must be understood that when actually constructing the machine for the continuous dynamic-fluid treatment of grouped filiform materials in accordance with the present invention, many changes in the details may be made that do not alter the machine's essential characteristics as summarized in the claims which follow.

We claim:

1. Machine for the dynamic-fluid treatment of grouped filiform textile materials in the form of a cord, cords, wicks, and the like comprising:

a feeder device for feeding and changing the density of filiform textile material comprising, an entry channel through which said material is passed at a first density, an exit channel spaced from said entry channel through which said material is passed at a second reduced density, two spaced movable elements disposed between said channels for engaging said material from said entry channel therebetween and changing the density thereof from said first to said second density, and means to operate said two movable elements; and a dynamic fluid treatment device comprising, a pressure treatment chamber formed by a stationary channel shaped part having an open side portion, and a moving part substantially closing said open side portion of said channel shaped part and movable relative thereto, an inlet in said channel shaped part for receiving said material from said exit channel of said feed device, an outlet in said channel shaped part for the discharge of said material therefrom, sealing means between said moving and stationary parts for making said treatment chamber substantially watertight except at said inlet and outlet, means for feeding treatment fluid into said pressure treatment chamber for treating said material therein, and transverse shoulder means on said moving part in said pressure treatment chamber for engagement with and moving of said material between said material inlet and outlet.

2. A machine as claimed in claim 1 wherein:

said two moving elements comprise two rotors; and said means for moving said moving elements comprises motor means, and drive means for driving said moving elements by said motor means.

3. A machine as claimed in claim 2 wherein:

said rotors are rotatably mounted on spaced axes for simultaneous rotation by said drive means; and lobes are provided on said rotors for engagement with said material out of phase with each other.

4. A machine as claimed in claim 3 wherein:

said entry and exit channels have relatively smaller and larger dimensions, respectively, determined by said first and second densities of said material.

5. A machine as claimed in claim 4 wherein:

said treatment chamber comprises a partial circular torus having a substantially rectangular shaped cross-section;

said stationary channel shaped part comprises a partially annular channel with said open side on the radially inward side thereof;

said moving part of said treatment device comprises a rotor and means for driving said rotor; and said shoulders extend substantially radially outwardly from said rotor into said treatment chamber.

6. A machine as claimed in claim 5 wherein said treatment fluid feeding means comprises:

at least one fluid feeding chamber on a part of said stationary channel shaped part;

a treatment fluid inlet for said fluid feeding chamber; and a plurality of openings in said stationary channel shaped part communicating said at least one fluid feeding chamber with said pressure treatment chamber for conducting treatment fluid into and out of said treatment chamber for treatment of said material therein.

7. A machine as claimed in claim 6 wherein:

a plurality of said treatment fluid feeding means are provided in spaced relationship between said material inlet and outlet.

8. A machine as claimed in claim 2 wherein:

said rotors are rotatably mounted on spaced axes for simultaneous rotation by said drive means; and said rotors have outer surfaces and serrations in said outer surfaces extending substantially parallel to the respective axes of rotation.

9. A machine as claimed in claim 1 wherein:

said entry and exit channels have relatively smaller and larger dimensions, respectively, determined by said first and second densities of said materials.

10. A machine as claimed in claim 1 wherein:

said treatment chamber comprises a partial circular torus having a substantially rectangular shaped cross-section;

said stationary channel shaped part comprises a partially annular channel with said open side on the radially inward side thereof;

said moving part of said treatment device comprises a rotor and means for driving said rotor; and said shoulders extend substantially radially outwardly from said rotor into said treatment chamber.

11. A machine as claimed in claim 1 wherein said treatment fluid feeding means comprises:

at least one fluid feeding chamber on a part of said stationary channel shaped part;

a treatment fluid inlet for said fluid feeding chamber; and a plurality of openings in said stationary channel shaped part communicating said at least one fluid feeding chamber with said pressure treatment chamber for conducting treatment fluid into and out of said treatment chamber for treatment of said material therein.

12. A machine as claimed in claim 11 wherein:

a plurality of said treatment fluid feeding means are provided in spaced relationship between said material inlet and outlet.

* * * * *